US008978841B2

(12) United States Patent
Ring

(10) Patent No.: US 8,978,841 B2
(45) Date of Patent: Mar. 17, 2015

(54) UNIVERSAL BRAKE ASSEMBLY

(75) Inventor: Michael E. Ring, Saint John, IN (US)

(73) Assignee: WABTEC Holding Corp, Wilmerding, PA (US)

( * ) Notice: Subject to any disclaimer, the term of this patent is extended or adjusted under 35 U.S.C. 154(b) by 963 days.

(21) Appl. No.: 13/014,249

(22) Filed: Jan. 26, 2011

(65) Prior Publication Data

US 2011/0147140 A1 Jun. 23, 2011

Related U.S. Application Data

(63) Continuation-in-part of application No. 11/480,804, filed on Jul. 3, 2006, now Pat. No. 7,931,130.

(60) Provisional application No. 60/696,942, filed on Jul. 6, 2005.

(51) Int. Cl.

| | |
|---|---|
| ***B60T 11/10*** | (2006.01) |
| ***B61H 13/24*** | (2006.01) |
| ***B61H 13/36*** | (2006.01) |

(52) U.S. Cl.

CPC ..... *B61H 13/24* (2013.01); *B61H 13/36* (2013.01)

USPC ..... 188/153 D; 188/124; 188/365; 188/366; 188/367; 188/368; 303/22.6

(58) Field of Classification Search

USPC ..... 188/33, 361, 153 R, 34, 49–55, 153 D, 188/365–368; 267/64.11

See application file for complete search history.

(56) References Cited

U.S. PATENT DOCUMENTS

| | | | | | |
|---|---|---|---|---|---|
| RE20,887 | E | * | 10/1938 | Mercier | 267/35 |
| 2,999,681 | A | * | 9/1961 | Muller et al. | 267/64.27 |
| 3,162,433 | A | * | 12/1964 | Smirl | 267/64.19 |
| 3,589,481 | A | * | 6/1971 | Motsch et al. | 188/345 |
| 4,467,605 | A | * | 8/1984 | Smith | 60/577 |
| 4,499,812 | A | * | 2/1985 | Pressaco et al. | 91/376 R |
| 4,693,486 | A | * | 9/1987 | Pierce et al. | 280/80.1 |
| 4,697,797 | A | * | 10/1987 | Gold | 267/64.24 |
| 4,787,606 | A | * | 11/1988 | Geno et al. | 267/64.27 |
| 4,846,785 | A | * | 7/1989 | Cassou et al. | 600/34 |
| 5,016,523 | A | * | 5/1991 | Bowyer | 92/63 |
| 5,024,424 | A | * | 6/1991 | Fejerdy et al. | 267/64.27 |
| 5,060,916 | A | * | 10/1991 | Koschinat et al. | 267/64.27 |
| 5,069,312 | A | * | 12/1991 | Kanjo et al. | 188/52 |
| 5,105,727 | A | * | 4/1992 | Bowyer | 92/63 |
| 5,193,432 | A | * | 3/1993 | Smith | 92/63 |

(Continued)

*Primary Examiner* — Robert A Siconolfi
*Assistant Examiner* — James Hsiao
(74) *Attorney, Agent, or Firm* — James Ray & Assoc

(57) ABSTRACT

A brake actuator assembly for a railway vehicle braking system includes a pair of end members spaced apart from each other along a longitudinal axis of the brake actuator assembly, a hollow flexible elastomeric member, two peripheral flanges extending outwardly from ends of the hollow flexible elastomeric member. Two retaining members, apertures and fasteners are employed for attaching each peripheral flange directly to a respectively positioned end member. The brake actuator assembly is connected to a source of fluid under pressure enabling inflation of the flexible elastomeric member and initiation of a braking sequence of the railway vehicle braking system. The brake actuator assembly of the instant invention allows for improved control of the brake shoe forces including visual travel measurement indication which is especially desirable during light load conditions. Currently used brake assemblies employing cylinder type actuators may be retrofitted with the brake actuator assembly of the instant invention.

20 Claims, 4 Drawing Sheets

(56) References Cited

U.S. PATENT DOCUMENTS

| | | | | |
|---|---|---|---|---|
| 5,201,500 | A * | 4/1993 | Ecktman et al. | 267/140 |
| 5,208,961 | A * | 5/1993 | Lajoie | 29/434 |
| 5,709,313 | A * | 1/1998 | Richoux et al. | 220/601 |
| 5,901,965 | A * | 5/1999 | Ringer et al. | 277/369 |
| 5,921,532 | A * | 7/1999 | Pierce et al. | 267/64.19 |
| 6,116,385 | A * | 9/2000 | Ring | 188/153 D |
| 6,230,851 | B1 * | 5/2001 | Yoshizawa et al. | 188/71.1 |
| 6,361,028 | B1 * | 3/2002 | Hubbell | 267/64.27 |
| 6,364,352 | B1 * | 4/2002 | Norton | 280/735 |
| 6,619,443 | B2 * | 9/2003 | Ring et al. | 188/153 R |
| 6,792,704 | B2 * | 9/2004 | Johnson | 37/235 |
| 7,416,262 | B2 * | 8/2008 | Ring | 303/22.2 |
| 8,033,533 | B2 * | 10/2011 | Ring et al. | 267/64.11 |
| 2004/0227322 | A1 * | 11/2004 | Mattocks | 280/124.157 |
| 2005/0040575 | A1 * | 2/2005 | Ring et al. | 267/140.12 |
| 2005/0200058 | A1 * | 9/2005 | Voelkel | 267/64.11 |
| 2006/0181145 | A1 * | 8/2006 | Stuani | 303/123 |
| 2006/0208402 | A1 * | 9/2006 | Keeney et al. | 267/64.11 |
| 2006/0237266 | A1 * | 10/2006 | Powers | 188/18 A |
| 2007/0006725 | A1 * | 1/2007 | Faller et al. | 91/376 R |
| 2007/0228623 | A1 * | 10/2007 | Egolf et al. | 267/118 |

* cited by examiner

252

UNIVERSAL BRAKE ASSEMBLY

CROSS-REFERENCE TO RELATED APPLICATIONS

This application is a Continuation-In-Part of U.S. patent application Ser. No. 11/480,804 filed Jul. 3, 2006, now issued as U.S. Pat. No. 7,931,130 on Apr. 26, 2011, and claiming priority from U.S. Provisional Patent Application Ser. No. 60/696,942 filed Jul. 6, 2005.

FIELD OF THE INVENTION

The present invention relates, in general, to a brake mechanism for use in railway vehicle brake assemblies and, more particularly, this invention relates to a brake mechanism using a pneumatic brake actuator assembly for initiating a braking sequence in railway vehicle brake assemblies and, still more specifically, the invention relates to truck-mounted brake assemblies.

BACKGROUND OF THE INVENTION

As is generally well known in the railway industry, truck mounted braking systems comprise a series of force transmitting members, levers and linkages which function to move a group of brake shoes against the wheels of a railway vehicle to effect stoppage of such railway vehicle. A pneumatic brake actuator is typically provided in the braking system to initiate movement of this series of force transmitting members, levers and linkages to apply the brakes of the railway vehicle mounted to a truck assembly of the railway vehicle.

Traditional pneumatic brake actuators generally comprise an air cylinder piston which moves in a forwardly direction within a cylindrical member upon the application of pneumatic pressure thereto. A seal and/or diaphragm is provided on or adjacent a first end of the piston. This seal and/or diaphragm contacts the inner surface of the cylindrical member so as to provide an airtight chamber at one end of the cylindrical member such that application of pneumatic pressure therein and against the first end of the piston enables forward movement of the piston.

A piston rod is attached at a second end of the piston and moves in response to the movement of the piston. An opposite end of the piston rod is connected to the end of a push rod which is, in turn, connected to a cylinder force transfer lever. This cylinder force transfer lever is connected through a series of force transmitting members and linkages so as to activate a braking sequence and apply the brake shoes to the vehicle wheels.

As it is well known, their inability to accommodate piston bail or misalignment without leaking air, need for maintenance of the seals and/or diaphragms within the cylindrical member to ensure that leaking of air does not occur and difficulties in controlling the movement and/or force applied by the piston are the main disadvantages of the airbrake cylinder.

SUMMARY OF THE INVENTION

The invention provides a brake actuator assembly for a railway car mounted brake assembly. The brake actuator assembly includes a first end member having an inner surface. There is also a second end member which is disposed in spaced apart relationship with the first end member along the longitudinal axis of the brake actuator assembly and having an inner surface opposing the inner surface of the first end member. A hollow flexible elastomeric member extended between the inner surfaces of the first and the second end members along the longitudinal axis. The flexible elastomeric member has each of an exterior peripheral surface and a pair of open ends. A first peripheral flange is disposed on a first end of the hollow flexible elastomeric member and extending outwardly from the exterior surface thereof in a direction transverse to the longitudinal axis, the first peripheral flange has a first surface thereof abutting an inner surface of one of the first and second end members. There is also a second peripheral flange which is disposed on a second end of the hollow flexible elastomeric member and extending outwardly from the exterior surface thereof in the direction transverse to the longitudinal axis, the second peripheral flange has a first surface thereof abutting an inner surface of an opposed one of the first and second end members. A securing means is provided for securing in a substantially sealed manner each of the first and second peripheral flanges to a respectively positioned end member. An arrangement is disposed in the one of the first and second end members in open communication with a substantially sealed fluid chamber defined in the flexible elastomeric member and in fluid communication with a source of fluid under pressure. The securing means includes a pair of retaining member and pluralities of apertures and fasteners.

OBJECTS OF THE INVENTION

It is an object of the present invention to provide a brake actuator assembly for a railway vehicle braking system that improves control of the brake shoe forces.

Another object of the present invention is to provide a brake actuator assembly that reduces the amount of pressure to be applied to the air spring actuator pushrod during light car conditions.

Still another object of the present invention is to provide a brake actuator assembly that is capable of linkage bail and/or misalignment without leaking air.

Yet another object of the present invention is to provide a brake actuator assembly that reduces effort required to maintain the air tightness of the system.

A further object of the present invention is to provide a brake actuator assembly that provides an economically desirable alternative to the seal/diaphragm system currently in use.

Still another object of the present invention is to provide a brake actuator assembly that provides for visual determination of its travel during brake actuation in order to determine the force applied by the brake shoes.

Yet an additional object of the present invention is to provide a brake actuator assembly which can be easily retrofitted into existing applications.

Although a number of objects and advantages of the present invention have been described in some detail above, various additional objects and advantages of the brake cylinder of the present invention will become more readily apparent to those persons who are skilled in the art from the following more detailed description of the invention, particularly, when such detailed description is taken in conjunction with both the attached drawing figures and with the appended claims.

Figure 1:
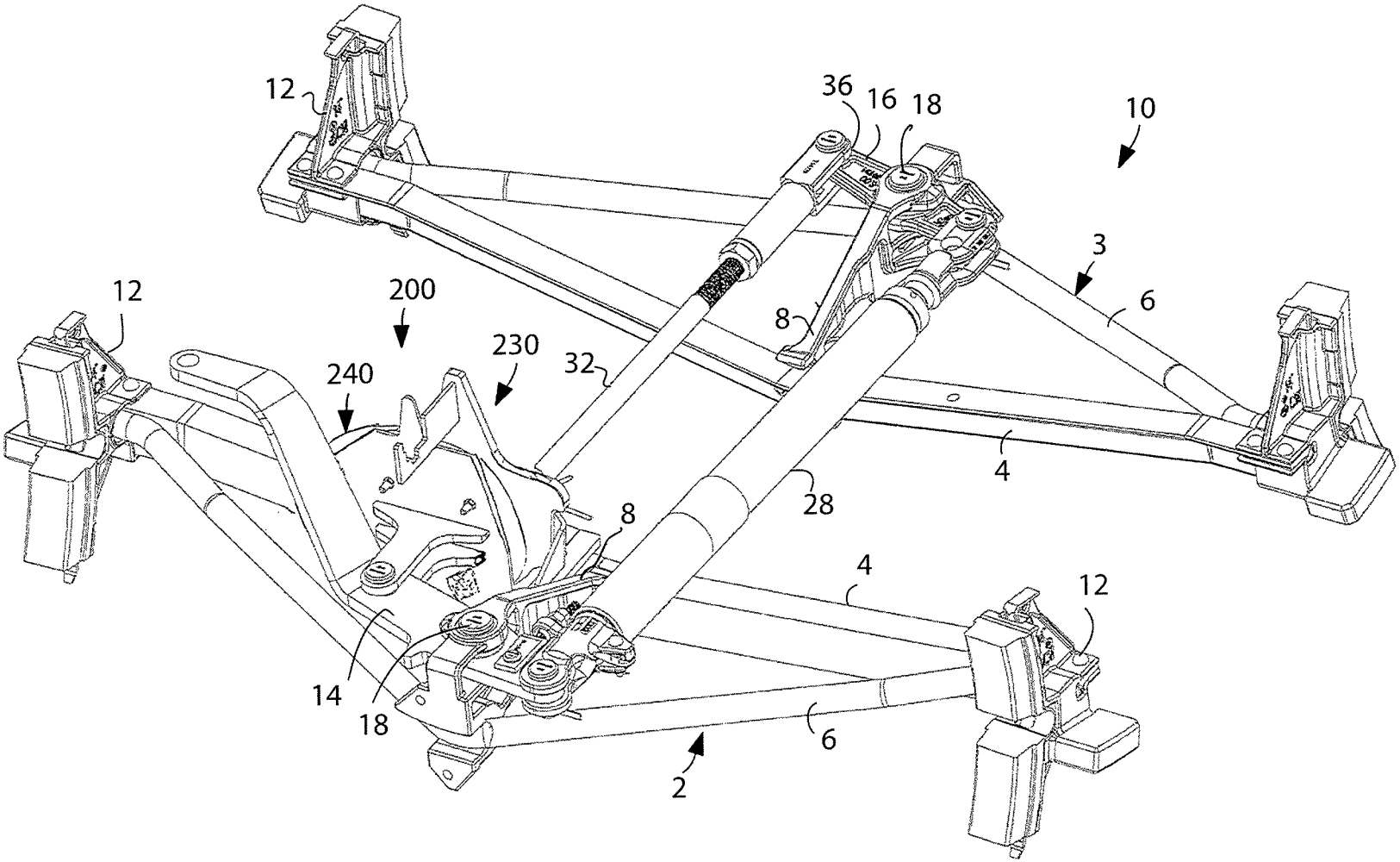
FIG. 1 is a perspective view of a railway vehicle truck mounted brake arrangement including a universal brake assembly of the instant invention.
Figure 2:
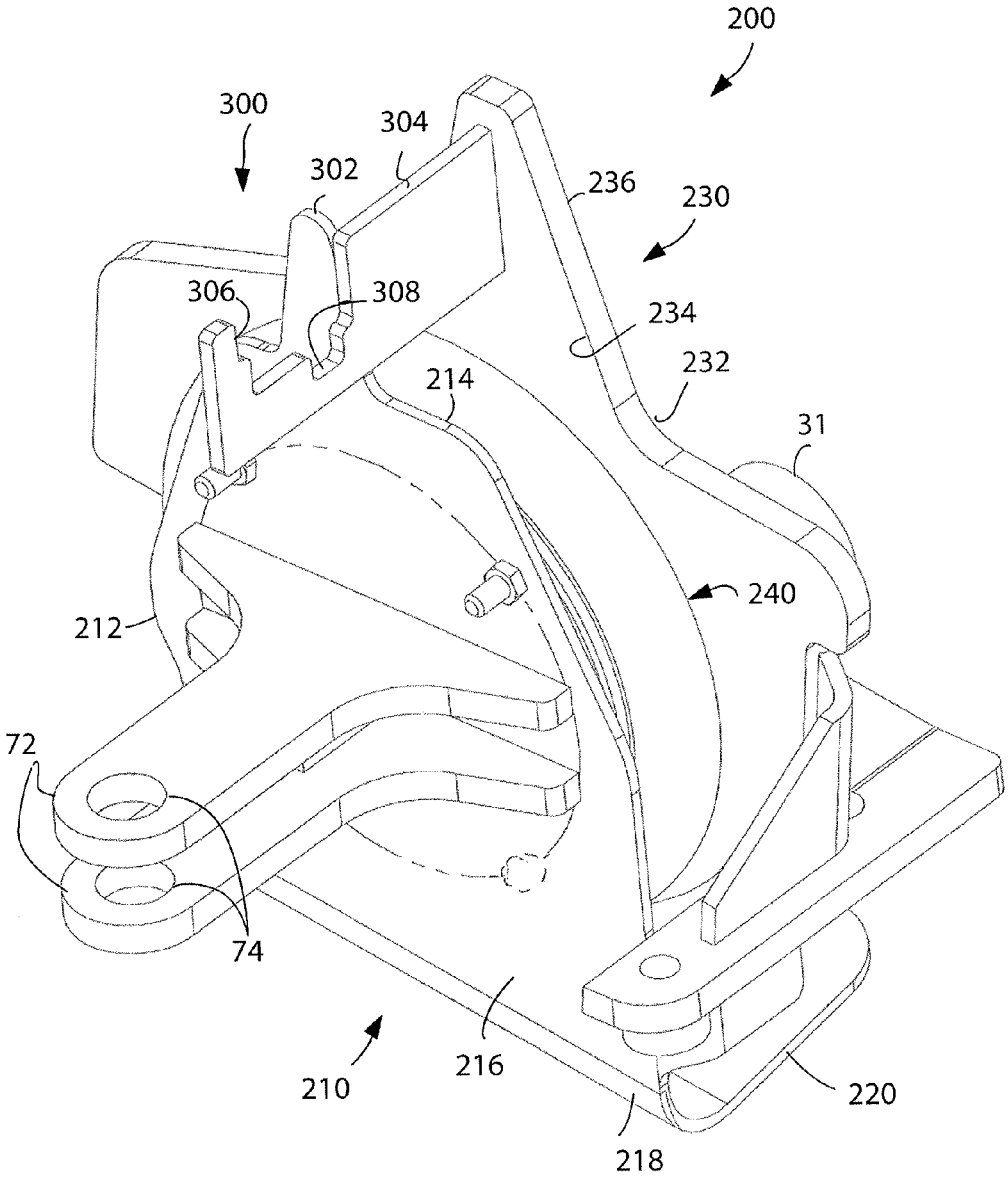
FIG. 2 is a perspective view of the brake actuator assembly of the instant invention.

DETAILED DESCRIPTION OF A PRESENTLY PREFERRED AND VARIOUS ALTERNATIVE EMBODIMENTS OF THE INVENTION

Prior to proceeding with the more detailed description of the invention, a description of a truck mounted braking system and its functioning should be helpful in understanding the present invention. Also, it should be noted that for the sake of clarity, identical components which have identical functions have been identified with identical reference numerals throughout the several views illustrated in the attached drawing figures.

Referring now to FIG. 1, there is shown a presently preferred embodiment of a truck-mounted brake assembly, generally designated 10, for a railway car (not shown). This brake assembly 10 comprises brake beams, generally designated 2 and 3, which are substantially identical. Each of the brake beams 2 and 3 includes a compression member 4, a tension member 6 and a strut member 8. The opposite ends of the compression member 4 and the tension member 6 may be permanently connected together, preferably by welding, along an outer segment (not shown) at the opposite ends of the compression member 4 and the tension member 6.

At a location substantially midway between their opposite ends, the compression member 4 and the tension member 6 of the, respective, brake beams 2 and 3 are spaced apart sufficiently to allow connection of the strut member 8 therebetween. Mounted on the respective outer end segments of the brake beams 2 and 3 are brake heads 12.

A pair of force-transfer levers 14 and 16 are pivotally connected by pins 18 to the strut member 8 of the respective brake beams 2 and 3. One end of the respective force-transfer levers 14 and 16 is interconnected via a force-transmitting member 28, which may be in the form of a slack adjuster device. The opposed end 36 of the force-transfer lever 16 is connected to a brake actuator assembly, generally designated as 200, by connecting means 31 via a force-transmitting member or a return push rod assembly 32.

Now in a particular reference to FIGS. 2-5, the brake actuator assembly 200 includes three essential members, such as a first end member, generally designated as 210, a second end member, generally designated as 230 and a flexible elastomeric member, generally designated as 240.

Figure 5:
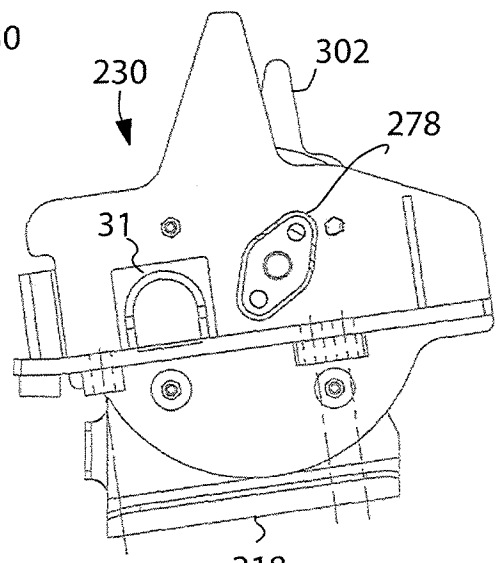
FIG. 5 is a rear elevation view of the brake actuator assembly of FIG. 2.
Figure 4:
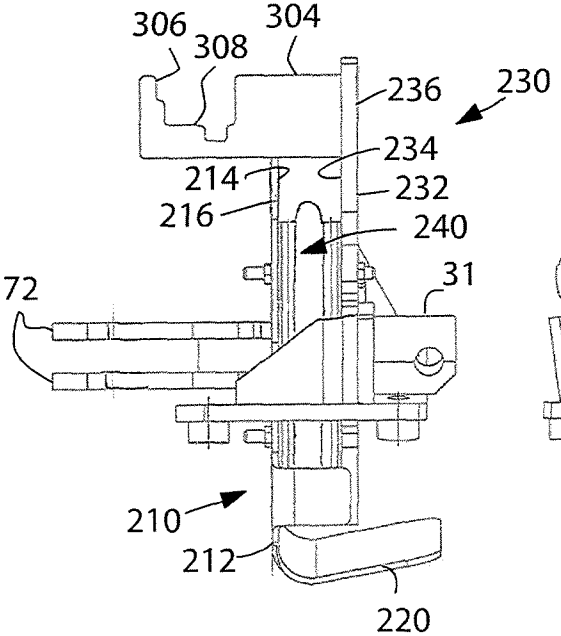
FIG. 4 is a side elevation view of the brake actuator assembly of FIG. 2.
Figure 3:
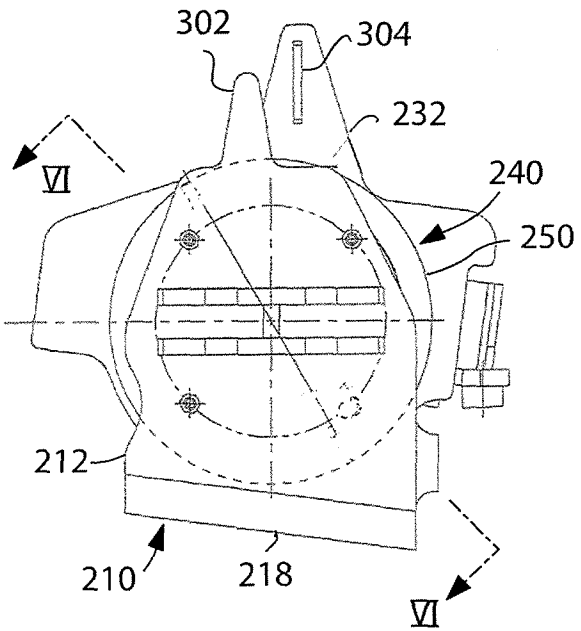
FIG. 3 is a front elevation view of the brake actuator assembly of FIG. 2.

The first end member 210 connects the brake actuator assembly 200 to the force-transfer levers 14 and also seals one end of the flexible elastomeric member 240. The first end member 210 is preferably rigid and includes a first portion 212 which is essentially a plate that is disposed generally vertical during operation of the brake actuator assembly 200. Such first portion 212 has an inner surface 214 and an opposed outer surface 216, which are substantially planar and are spaced apart from each other to define thickness of the first portion 212. The first end member 210 may also include at least a second portion 220, being also a plate shaped, that is disposed at the bottom edge 218 of the first portion 212 and extend outwardly from the inner surface 214. The second portion 220 may extend in a direction substantially perpendicular to the first portion 214 or may be disposed at an angle thereto, as best shown in FIGS. 3 and 5. Preferably, the first portion 212 and the second portion 220 are formed integral with each other as a one-piece member, for example such as by a simple bending process. A pair of elongated spaced apart plate shaped members 72 are disposed on the second surface 216 and extend outwardly therefrom. Each of the pair of elongated spaced apart plate shaped members 72 has a conventional aperture 74 so as to connect the first end member 210 to the force-transfer levers 14. The pair of elongated spaced apart plate shaped members 72 may be formed integral with the first portion 212 or may be attached thereto by way of fasteners and apertures.

The second end member 230 is also preferably rigid and has a portion 232 which is essentially a plate that is disposed generally vertical during operation of the brake actuator assembly 200. Such portion 232 has an inner surface 234 and an opposed outer surface 236, which are substantially planar and are spaced apart from each other to define thickness of the portion 232. Furthermore, the inner surface 234 opposes the inner surface 214 of the first portion 212 of the first end member 210. Means is disposed on and attached to the outer surface 236 so as to connect the brake actuator assembly 200 to the brake beam 4.

Now in a particular reference to FIGS. 6*a-d*, the hollow flexible elastomeric member 240 extends between the first end member 210 and the second end member 230. The flexible elastomeric member 240 has a predetermined shape and a predetermined length. The presently preferred shape of the flexible elastomeric member 240 has a generally annular cross-section in a direction transverse to a longitudinal axis 202 of the brake actuator assembly 200. The flexible elastomeric member 240 further has a first open end 242 and an axially opposed second end 246. The preferred material of such flexible elastomeric member 240 is a multi-ply rubberized fabric material. The shape of the flexible elastomeric member 240 may be a bellow, a simple cylindrical sleeve or any other shape suitable for reciprocal expansion and contraction along the longitudinal axis 202. In either shape, the flexible elastomeric member 240 has a hollow interior.

A first peripheral flange 260 is provided and is disposed on a first end 242 of the hollow flexible elastomeric member 240. The first peripheral flange 260 further extends outwardly in a direction transverse to the longitudinal axis 202 from the exterior surface 250 of the hollow flexible elastomeric member 240. The first peripheral flange 260 has a generally planar first surface 262 thereof abutting an inner surface 214, 232 of one of the first and second end members, 210 and 230 respectively and being best shown as a first end member 210 in FIGS. 6*a* and 6*c*.

There is also a second peripheral flange 270 that is disposed on a second end 246 of the hollow flexible elastomeric member 240 and that also extends outwardly in the direction transverse to the longitudinal axis 202 from the exterior surface 241 of the flexible elastomeric member 240. The second peripheral flange 270 has a generally planar first surface 272 thereof abutting an inner surface 214, 232 of an opposed one of the first and second end members, 210 and 230 respectively, and being best shown as a second end member 230 in FIGS. 6*b* and 6*d*.

Preferably, the first and second peripheral flanges, 260 and 270 respectively, are identical and have an annular shape. It is further preferred for the flanges 260 and 270 to be formed integral with the flexible elastomeric member 240 as a one-piece member, for example by a molding process. However, the thickness of each flange 260, 270 may differ from the thickness of the flexible elastomeric member 240, so as to facilitate attachment of the flexible elastomeric member 240 to end members 210, 203.

There is also means, generally designated as 280, for securing, in a substantially sealed manner, each of the first and second peripheral flanges, 260 and 270 respectively, to a respectively positioned end member 210 or 230.

The final element of the brake actuator assembly 200 is an arrangement 278 disposed in the one of the first and second end members 210, 230 in open communication with a substantially sealed fluid chamber 252 defined in the flexible elastomeric member 240 and in fluid communication with a conventional source of fluid under pressure (not shown). The arrangement 278 allows supply of fluid under pressure to inflate the sealed fluid chamber 252 causing a generally linear movement of one end member along the longitudinal axis 202 in a direction away from an opposed one end member and removal of the fluid under pressure will deflate the sealed fluid chamber 252 causing the generally linear movement of the one end member in a direction toward the opposed one end member, and whereby selective inflation and deflation of the flexible elastomeric member 240 causes a reciprocal motion of the brake actuator assembly 200 to move the control linkages 14, 16 and the force transmitting members 28, 31 for actuating and releasing the brake shoes. Here, the first end member 210 will reciprocally move relative to the second end member 230 which is stationary attached to the brake beam 4.

The securing means 280 preferably includes a pair of retaining members 282, which are preferably (annular) ring shaped, each engaging a predetermined portion of one of the first and second peripheral flanges, 260 and 270 respectively, and plurality of fastening means. As it will be explained below, the fastening means includes threaded fasteners and apertures formed through thickness of at least one of the first and second end member 210 and 230 respectively, the first and second peripheral flanges 260 and 270 respectively and the pair ring shaped members 282.

Figure 6A:
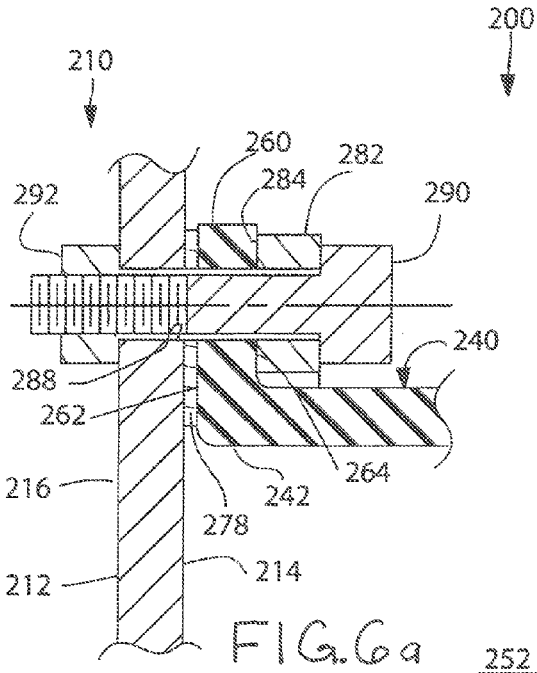
FIGS. 6*a-d* illustrate partial cross-sectional views of the brake actuator assembly along lines VI-VI of FIG. 3.
Figure 6B:
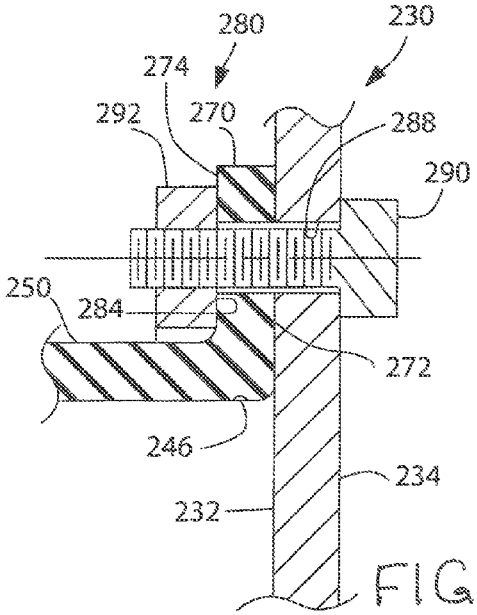
Figure 6C:
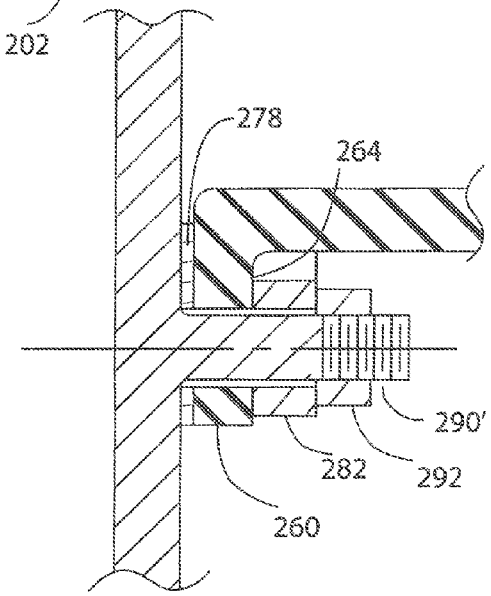

In accordance with one form of the invention, one ring 282 has one substantially planar surface 284 thereof abutting the substantially planar second surface 264 of the first peripheral flange 260, which defines such predetermined portion thereof, while the other ring 282 has the substantially planar surface 284 thereof abutting the substantially planar second surface 274 of the second peripheral flange 270, which defines such predetermined portion thereof. Apertures 288, which are preferably disposed in a circular pattern, are then formed through thickness of each of the end members 210, 230, peripheral flanges 260, 270 and rings 282. An elongated fastener 290, such as a conventional bolt, is passed through each aperture 288, and another threaded fastener 292, such as a conventional nut, is operatively threaded onto the threaded end of the threaded fastener 290 and is advanced to essentially clamp each peripheral flange 260, 270 between its respective end member 210, 230 and the ring 282. It would be understood that each aperture 288 is essentially consists of at least two, and generally three, different aperture portions that are aligned therebetween during assembly of the brake actuator assembly 200. Alternatively to the nut 292, the portion of the aperture 288 formed through either end member 210, 230 or ring 282 may be threaded. Yet alternatively, the elongated fastener 290' may be a conventional stud that has one end thereof being pressed into an aperture in either end member 210, 230 or ring 282 and an opposed end thereof being threaded to operatively receive a threaded nut 292, as best shown in FIG. 6*c*. It is also contemplated that threaded nut fastener 292 may be permanently secured to either end member 210 or 230 or the retaining member 282, for example by a welding process.

Figure 6D:
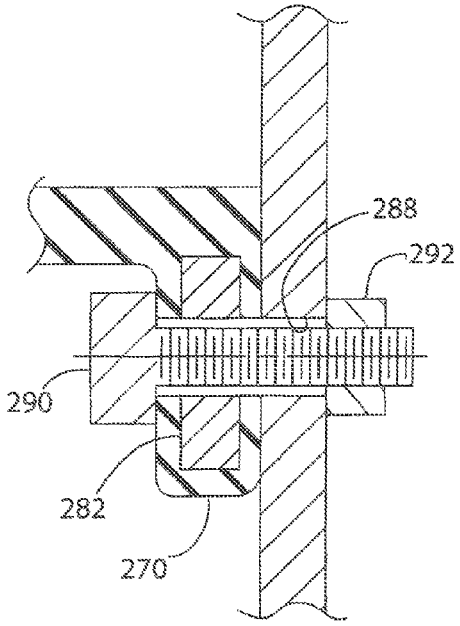

In accordance with another form of the invention, at least one, and preferably each retaining member 282 is imbedded within a respective peripheral flange 260, 270. The term imbedded is meant to define here that the retaining member 282 is surrounded by material of the respective peripheral flange 260, 270, as best shown in FIG. 6*d*. For example the retaining member 282 may be placed into the mold during molding operation of the peripheral flange 260 or 270. The apertures 288 are then formed through at least the partial thickness of the peripheral flange 260 or 270, including retaining member 282, and through the end member 210 or 230. Thus, in this embodiment, the predetermined portion of each of the first and second flange 260 and 270 respectively is a body portion thereof. Here, the portion of the aperture 288 formed through imbedded retaining member 282 may be threaded so as to eliminate use of the threaded nut 292. Optionally, a plurality of retaining members, rather than one continuous retaining member 282, may be imbedded within the flange 260 and/or 270.

If required, an optional sealant 278 can be applied to either end member 210, 230 or peripheral flanges 260, 270 prior to fastening such members therebetween. Furthermore, the surfaces 264 and 274 may be provided with serrations or ridges (not shown) to facilitate sealing of each flange 260, 270 to a respectively positioned end member 210, 230.

Brake actuator assembly 200 may include optional means, generally designated as 300, for indicating travel distance of the brake actuator assembly 200. By way of an example only, such means 300 for indicating travel distance includes a portion 302 extending from an edge of one of the pair of end members 210, 230 substantially planar therewith and a plate shaped member 304 disposed on and extending outwardly from the inner surface of the opposed one of the pair of end members 210, 230. The plate shaped member 304 is adapted with at least one notch 306 formed through a thickness thereof, whereby the portion 302 is disposed generally perpendicular to the plate member 304 so that thickness of the portion 302 moves within the at least one notch 306 during brake application and release. Preferably the bottom edge 308 of the at least one notch 306 has an irregular shape so as to clearly indicate various operating conditions of the brake actuator assembly 200.

Currently used brake cylinder assemblies may be retrofitted with the brake actuator assembly 200 of the instant invention by replacing the cylinder assembly with the brake actuator assembly 200 having a predetermined push rod/shield and mounting bracket arrangements to interface with the existing brake rigging, either truck mounted or car mounted.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. In a combination with a railway car mounted brake assembly including a pair of brake beams mounted at each end of said car mounted brake assembly, each of said brake beams having a brake head attachable to each end thereof, each of said brake heads carrying a brake shoe thereon, said each of said brake heads being positioned for engagement of a respective one of said brake shoes with a respective railway vehicle wheel during a brake application, said each of said brake beams having a control linkage pivotally attached thereto, a first force transmitting member attached to opposed first ends of each of said control linkages and a second force transmitting member attached to a second end of one of said control linkage and extending generally parallel to a longitudinal axis of said brake assembly toward a respectively opposed second end of an opposed one of said control linkage; a brake actuator assembly connected to and disposed intermediate said second force transmitting member and said second control linkage for applying and releasing said brake shoes, said brake actuator assembly comprising:

(a) a first end member having an inner surface;

(b) a second end member disposed in a spaced apart relationship with said first end member along said longitudinal axis of said brake actuator assembly and having an inner surface thereof opposing said inner surface of said first end member;

(c) a hollow flexible elastomeric member extending between said inner surfaces of said first and said second end members along said longitudinal axis, said flexible elastomeric member having each of an exterior peripheral surface and a pair of open ends;

(d) a first peripheral flange disposed on a first end of said hollow flexible elastomeric member and extending outwardly from said exterior surface thereof in a direction transverse to said longitudinal axis, said first peripheral flange having one surface thereof abutting an inner surface of one of said first and second end members;

(e) a second peripheral flange disposed on a second end of said hollow flexible elastomeric member and extending outwardly from said exterior surface thereof in said direction transverse to said longitudinal axis, said second peripheral flange having one surface thereof abutting an inner surface of an opposite one of said first and second end members;

(f) a securing means for securing in a substantially sealed manner each of said first and second peripheral flanges to a respectively positioned end member, said securing means includes a pair of ring shaped members, apertures formed through a thickness of each of said pair of ring shaped members, through a thickness of each of said first and second members, and through a thickness of each of said first and second peripheral flanges, and a plurality of fastening means; and (g) an arrangement disposed in said one of said first and second end members in open communication with a substantially sealed fluid chamber defined in said flexible elastomeric member and in fluid communication with a source of fluid under pressure.

2. The brake actuator assembly, according to claim 1, wherein each of said pair of ring shaped members engages a portion of one of said first and second peripheral flanges.

3. The brake actuator assembly, according to claim 2, wherein said fastening means includes elongated threaded fasteners received within aligned apertures in said each of said pair of ring shaped members, said each of said first and second members, and said each of said first and second peripheral flanges and wherein said fastening means further includes nut fasteners.

4. In combination with a railway car mounted brake assembly including a pair of brake beams mounted at each end of said car mounted brake assembly, each of said brake beams having a brake head attachable to each end thereof, each of said brake heads carrying a brake shoe thereon, said each of said brake heads being positioned for engagement of a respective one of said brake shoes with a respective railway vehicle wheel during a brake application, said each of said brake beams having a control linkage pivotally attached thereto, a first force transmitting member attached to opposed first ends of each of said control linkages and a second force transmitting member attached to a second end of one of said control linkage and extending generally parallel to a longitudinal axis of said brake assembly toward a respectively opposed second end of an opposed one of said control linkage; a brake actuator assembly connected to and disposed intermediate said second force transmitting member and said second control linkage for applying and releasing said brake shoes, said brake actuator assembly comprising:

(a) a first end member having an inner surface;

(b) a second end member disposed in spaced apart relationship with said first end member along said longitudinal axis of said brake actuator assembly and having an inner surface thereof opposing said inner surface of said first end member;

(c) a hollow flexible elastomeric member extending between said inner surfaces of said first and said second end members along said longitudinal axis, said flexible elastomeric member having each of an exterior peripheral surface and a pair of open ends;

(d) a first peripheral flange disposed on a first end of said hollow flexible elastomeric member and extending outwardly from said exterior surface thereof in a direction transverse to said longitudinal axis, said first peripheral flange having one surface thereof abutting an inner surface of one of said first and second end members;

(e) a second peripheral flange disposed on a second end of said hollow flexible elastomeric member and extending outwardly from said exterior surface thereof in said direction transverse to said longitudinal axis, said second peripheral flange having one surface thereof abutting an inner surface of an opposed one of said first and second end members;

(f) a first retaining member disposed in an engagement with a predetermined portion of said first peripheral flange and in a spaced apart relationship with said one of said first and second end members so as to cage said first peripheral flange therebetween;

(g) a second retaining member disposed in an engagement with a predetermined portion of said second peripheral flange and in a spaced apart relationship with said opposed one of said first and second end members so as to cage said second peripheral flange therebetween;

(h) a securing means operatively engaging a respectively positioned end member, flange and retaining member so as to define a substantially sealed fluid chamber in said flexible elastomeric member; and (i) an arrangement disposed in said one of said first and second end members in open communication with said fluid chamber and in fluid communication with a source of fluid under pressure.

5. The brake actuator assembly, according to claim 4, wherein said securing means includes pluralities of apertures formed through thickness of each of said respectively positioned end member, flange and retaining member and fasteners at least passed through said pluralities of apertures.

6. The brake actuator assembly, according to claim 5, wherein portion of said apertures formed through at least one of said first and second said end members are threaded.

7. The brake actuator assembly, according to claim 4, wherein said securing means includes pluralities of apertures formed through thickness of each of said respectively positioned flange and retaining member, a plurality of elongated members disposed on and extending outwardly from said inner surface of said end member and passing through said pluralities of apertures, each of said plurality of elongated members having a threaded end thereof adapted to receive a threaded fastener.

8. The brake actuator assembly, according to claim 4, wherein said flexible elastomeric member has a generally annular cross-section in a direction transverse to said longitudinal axis.

9. The brake actuator assembly, according to claim 8, wherein each of said first and second peripheral flanges has an annular shape.

10. The brake actuator assembly, according to claim 9, wherein each of said first and second retaining members has an annular shape.

11. The brake actuator assembly, according to claim 4, wherein each retaining member is imbedded within a thickness of a respective peripheral flange.

12. The brake actuator assembly, according to claim 11, wherein said brake actuator assembly includes a plurality of apertures formed through a thickness of said each retaining member and said thickness of said respective peripheral flange.

13. The brake actuator assembly, according to claim 4, wherein said inner surface of each of said first and second end members is substantially planar.

14. The brake actuator assembly, according to claim 4, wherein said predetermined portion of each of said first and second peripheral flange is an opposed surface thereof disposed in a generally uniform spaced relationship from said one surface.

15. The brake actuator assembly, according to claim 14, wherein each retaining member is disposed in an abutting engagement with said other surface of a respectively positioned peripheral flange.

16. The brake actuator assembly, according to claim 4, wherein said predetermined portion of each of said first and second flanges is a body portion thereof.

17. The brake actuator assembly of claim 4, further including means for indicating travel distance of said brake actuator assembly.

18. The brake actuator assembly, according to claim 17, wherein means for indicating travel distance includes a portion extending from an edge of one of said pair of end members substantially planar therewith and a plate shaped member disposed on and extending outwardly from said inner surface of an opposed one of said pair of end members, said plate shaped member having at least one edge notch formed through a thickness thereof, whereby said portion is disposed generally perpendicular to said plate member and wherein a thickness of said portion is disposed within said at least one notch during at least brake actuation condition.

19. In a combination with a railway car mounted brake assembly including a pair of brake beams mounted at each end of said car mounted brake assembly, each of said brake beams having a brake head attachable to each end thereof, each of said brake heads carrying a brake shoe thereon, said each of said brake heads being positioned for engagement of a respective one of said brake shoes with a respective railway vehicle wheel during a brake application, said each of said brake beams having a control linkage pivotally attached thereto, a first force transmitting member attached to opposed first ends of each of said control linkages and a second force transmitting member attached to a second end of one of said control linkage and longitudinally extending toward a respectively opposed second end of an opposed one of said control linkage; a brake actuator assembly connectable to and disposed intermediate said second force transmitting member and said second control linkage for applying and releasing said brake shoes, said brake actuator assembly comprising:

(a) a first end member disposed substantially vertically during use of said brake actuator assembly and having a substantially planar inner surface, said first end member further having a plurality of first apertures formed in a circular pattern through a thickness thereof;

(b) a second end member disposed substantially vertically during use of said brake actuator assembly in a spaced apart relationship with said first end member along longitudinal axis of said brake actuator assembly and having a substantially planar inner surface, said second member further having a plurality of second apertures formed in a circular pattern through a thickness thereof;

(c) a hollow flexible elastomeric member extending between said inner surfaces of said first and said second end members along said longitudinal axis, said flexible elastomeric member having each of a generally annular cross-section in a direction transverse to said longitudinal axis and an exterior peripheral surface thereof exposed to an operating environment characterized by a presence of a detrimental extraneous foreign material, said flexible elastomeric member further having a pair of open ends;

(d) a first annular flange disposed on a first end of said hollow flexible elastomeric member and extending outwardly from said exterior surface thereof in said direction transverse to said longitudinal axis, said first annular flange having one surface thereof abutting an inner surface of one of said first and second end members, said first annular flange further having a plurality of third apertures formed in said circular pattern through a thickness thereof and in an alignment with said plurality of first or second apertures;

(e) a second annular flange disposed on a second end of said hollow flexible elastomeric member and extending outwardly from said exterior surface thereof in said direction transverse to said longitudinal axis, said second annular flange having one surface thereof abutting an inner surface of an opposed one of said first and second end members, said second annular flange further having a plurality of fourth apertures formed in said circular pattern through a thickness thereof and in an alignment with said plurality of first or second apertures;

(f) a first ring abuttingly engaging an opposed surface of said first annular flange or being embedded within a thickness thereof, said first ring having a plurality of fifth apertures formed through a thickness of said first ring and disposed in an alignment with said plurality of apertures of a respectively positioned annular flange and end member;

(g) a second ring abuttingly engaging an opposed surface of said first annular flange or being embedded within thickness thereof, said second ring having a plurality of sixth apertures formed through a thickness thereof and disposed in an alignment with said plurality of apertures of a respectively positioned annular flange and end member;

(h) fasteners at least passed through aligned apertures between a respectively positioned end member, flange and ring so as to define a fluid chamber in said flexible elastomeric member;

(i) means for connecting said brake actuator assembly to said control linkage;

(j) means for securing said brake actuator assembly to at least one of said brake beam and said second force transmitting member; and (k) an arrangement disposed in said one of said first and second end members in open communication with said fluid chamber and in fluid communication with a source of fluid under pressure, whereby supply of fluid under pressure will inflate a sealed chamber within said flexible elastomeric causing a generally linear movement of one end member along said longitudinal axis in a direction away from an opposed one end member and removal of said fluid under pressure will deflate said sealed chamber causing said generally linear movement of said one end member in a direction toward said opposed one end member, and whereby selective inflation and deflation of said flexible elastomeric member causes a reciprocal motion of said brake actuator assembly to move said control linkages and said force transmitting members for actuating and releasing said brake shoes.

20. The brake actuator assembly, according to claim 1, wherein said first and second peripheral flanges are being integral with said hollow flexible elastomeric member as a one-piece member.

* * * * *